United States Patent [19]

Pugliese

[11] 4,102,353

[45] Jul. 25, 1978

[54] TEMPORARY SHELTER

[76] Inventor: Charles Pugliese, 83 Peguot La., E. Islip, N.Y. 11730

[21] Appl. No.: 762,998

[22] Filed: Jan. 27, 1977

[51] Int. Cl.[2] ..... A45F 1/06

[52] U.S. Cl. ..... 135/5 R; 52/63; 135/7.1 R; 160/349 R

[58] Field of Search ..... 135/5 R, 5 A, 5 AT, 135/7.1 R, 7.1 A, 3 R, 5.1, 76; 160/22, 46, 349; 4/149, 154; 52/63

[56] References Cited

U.S. PATENT DOCUMENTS

| | | | |
|---|---|---|---|
| 873,038 | 12/1907 | Garret | 135/7.1 R |
| 2,255,837 | 9/1941 | Volk | 135/5 R |
| 3,003,198 | 10/1961 | Kronhaus et al. | 135/5 R |
| 3,092,126 | 6/1963 | Smith | 135/5 A |
| 3,353,548 | 11/1967 | Staller | 135/5 R |

FOREIGN PATENT DOCUMENTS

| | | | |
|---|---|---|---|
| 2,312,723 | 9/1973 | Fed. Rep. of Germany | 135/5 AT |

*Primary Examiner*—Thomas F. Callaghan
*Assistant Examiner*—Conrad L. Berman
*Attorney, Agent, or Firm*—Posnack, Roberts, Cohen & Spiecens

[57] ABSTRACT

A portable enclosure useful as a temporary shelter that is attachable to a permanent shelter having side bars attachable to the permanent shelter and a cross bar attachable to the side bars at the ends remote from the permanent shelter. Side panels are slidably attached to the permanent shelter, the side bars and vertical bars which in turn are attached to anchors and to the cross bar. A removable roof is attachable to the side bars to cover the enclosure.

3 Claims, 5 Drawing Figures

TEMPORARY SHELTER

PRIOR ART

The following patents are considered pertinent:
U.S. Pat. No. 2,567,995
U.S. Pat. No. 2,670,504
U.S. Pat. No. 2,788,791
U.S. Pat. No. 2,840,091
U.S. Pat. No. 3,003,198
U.S. Pat. No. 3,217,722
U.S. Pat. No. 3,503,566
U.S. Pat. No. 3,923,074

BACKGROUND OF THE INVENTION

This invention relates to a portable enclosure construction suitable as a portable garage or patio.

There are available a wide variety of portable enclosures such as awnings or the like employed to shield persons from the sun and the weather. However, they are formed of complex and expensive structures and are awkward which requires undesirable time for installation and removal.

It is an object of this invention to provide a portable enclosure which is effective for providing protection against outside weather, which is of simple and inexpensive construction and which requires little time to install or remove.

SUMMARY OF THE INVENTION

The portable enclosure is attachable to a permanent structure and is designed so that its component parts are quickly and easily joined to complete the enclosure. The enclosure is of a size as to permit the user to work on a motor vehicle with the hood open while providing protection against the outside weather. Side bars are attachable to sockets rigidly attached to the permanent structure and to a cross bar positioned at the ends of the side bars remote from the permanent structure. Panels are hung from the side bars and are slidably positioned to slots rigidly attached to the permanent structure. The panels also are secured to poles that are anchored in the ground and are slidably connected to the cross bar and one side bar. A roof is positioned over the enclosure and is attached to side bars and the cross bar.

DETAILED DESCRIPTION OF THE PREFERRED EMBODIMENT

Figure 1:
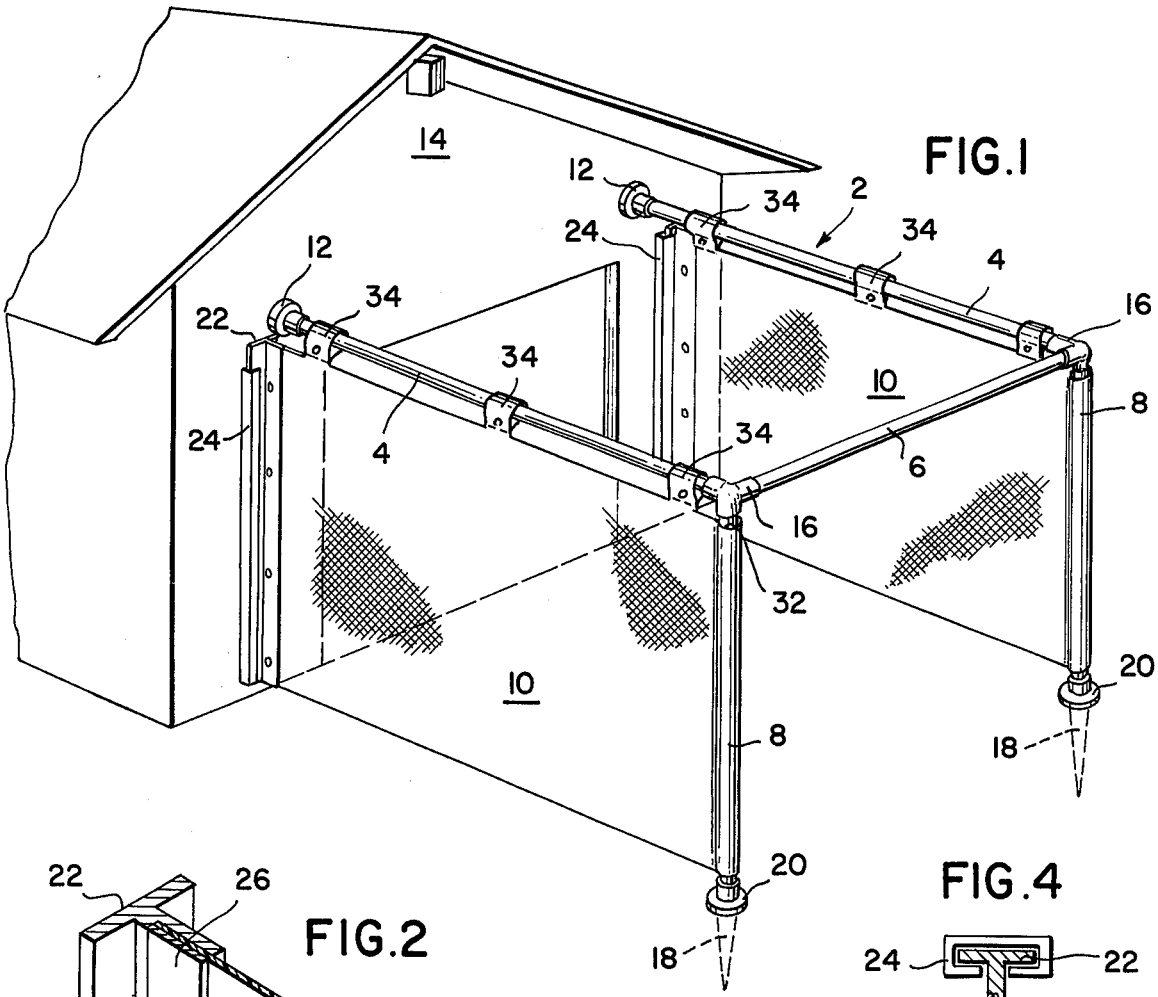
FIG. 1 is a perspective view of the structure of this invention without the roof.

Referring to the figures, the portable enclosure 2 includes two side bars 4, a cross bar 6, two poles 8, and two side panels 10. The side bars 4 are slidably positioned in horizontally open receptacles or sockets 12 which are rigidly attached to permanent structure 14. The side bars 4, cross bar 6 and poles 8 are connected by means of three-way sockets 16 into which the side bars

4, cross bar 6 and poles 8 are slidably connected. The poles 8 are slidably connected to spike-shaped anchors 18 that extend into the ground and which are provided with upwardly open receptacles and flanges 20 to limit the height at which the poles 8 are positioned.

Figure 2:
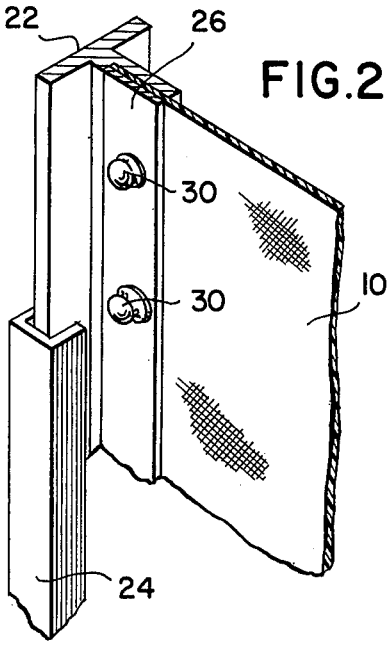
FIG. 2 is a partial view of the side panel positioned in the slot rigidly attached to the permanent structure.
Figure 4:
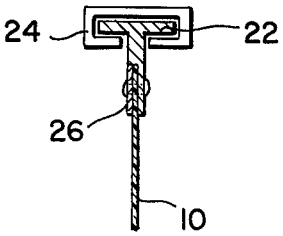
FIG. 4 is a top view of the side panel positioned in the slot.

As shown in detail in FIGS. 2 and 4, the side panels 10 which can be formed of a light material such as canvas are attached to a T-shaped support 22 that is positioned along the length of slots or slot defining channels 24. The side panels 10 are provided with nibs 26 having holes to accommodate rivets 30 that function to attach the panel 10 to the T-shaped support 22. The panels 10 are provided with end channels 32 that are sewn into the canvas and which are of a size to accommodate the poles 8 along their length. The panels 10 are slidably attached to side bars 4 by tongue extensions 34 of the canvas which enclose the side bar 4 and are fastened to themselves in any convenient manner such as with rivets.

Figure 3:
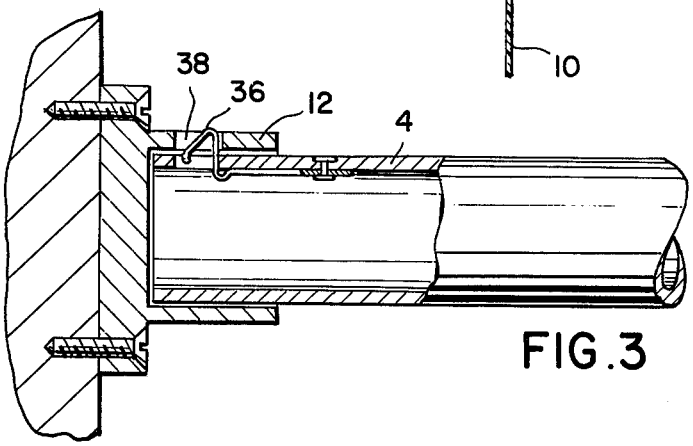
FIG. 3 is a partial cross-sectional view of the side bar positioned in a socket rigidly attached to the permanent structure.

As shown in FIG. 3, the side bar 4 is provided with a releasable catch or spring clip 36 which is positioned in hole 38 when side bar 4 is slid into socket 12.

Figure 5:
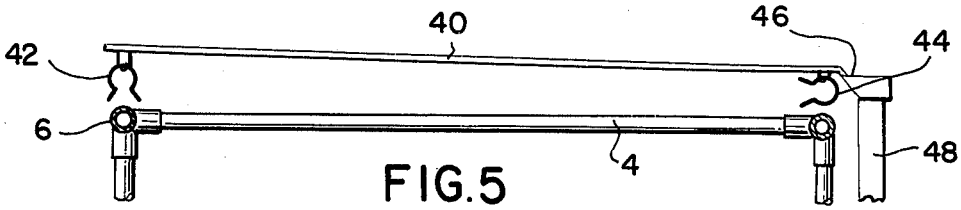
FIG. 5 is a side view in partial cross section of the roof as it is attached to a side bar and the cross bar.

As shown in FIG. 5, the roof 40 is attached to cross bar 6 by means of a spring clip 42 and to the side bars 4 by means of spring clip 44. The spring clips 42 and 44 are permanently attached to the roof 40 by any suitable means. The roof 40 optionally can be provided with a rain gutter 46 and down spout 48 positioned adjacent the permanent structure 14 to minimize water flow into the portable enclosure 2. If desired, a front panel made of a flexible material such as canvas can be attached to cross bar 6 to extend across the front opening by any suitable attachment means such as with the self-attaching canvas tongues described above.

When the portable enclosure is utilized as a portable garage, the side panels should be sufficiently under the door of a permanent garage to which they are attached to provide adequate moving space. In addition, the roof should be positioned sufficiently high as to permit the hood of motor vehicle to be opened fully. When the portable enclosure is to be utilized as a patio or the like, windows formed of flexible transparent material can be sewn into the side panels 10.

In constructing the temporary enclosure, the T-shaped members 22 of the side panels 10 are positioned into the slots 24 and the poles 8 are positioned onto anchors 18. The side bars are slid through the tongues 34 and are positioned so that spring clips 36 are positioned into slots 38. The cross bar 6 which optionally can be rigidly attached to three-way sockets 16 then is positioned so that the sockets 16 slidably engage the poles 8, side bars 4 and cross bar 6. The roof 40 then is clipped to the side bar 4 and cross bar 6.

It is to be understood that modifications can be made of the detailed structure described above without departing from the scope of this invention. For example, if a driveway has width extending beyond the width between the slots 24, the anchors 18 can be placed into the ground beyond the driveway and extensions can be provided between the poles 8 and the anchors 18 to permanently position the poles 8 at a distance apart corresponding to the width of the slot 24. Also the slots 24 can be of any shape so long as they accommodate a rigid member of suitable shape that is attached to the panels 10 along their height. In addition, the panels need not be formed of a flexible material so long as suitable means are provided for attaching the panels to the poles and side bars non-rigidly.

I claim:

1. A portable enclosure adapted for attachment to a permanent structure which rests on the ground, said enclosure comprising means for mounting on said structure and for providing spaced, parallel and vertical slots, means for installation in the ground at positions spaced from and corresponding to said slots and for providing upwardly open receptacles, means for installation on said structure above said slots and for providing horizontally open receptacles, side bars extending horizontally outwards from said horizontally open receptacles, a cross-bar extending between said side bars above said upwardly open receptacles, poles extending upwardly out of said upwardly open receptacles, three-way sockets interconnecting said poles, side bars and cross-bar, side panels engaged with said side bars and poles, T-shaped supports on said panels and slidably engaged in said slots, releasable catches on said side bars holding the latter within the horizontally open receptacles, said side bars and cross-bar constituting a horizontal frame, a roof, and spring clips releasably attaching said roof to said horizontal frame.

2. A portable enclosure as claimed in claim 1 comprising a rain gutter on said roof and spout depending from said gutter.

3. A portable enclosure as claimed in claim 1 wherein the second said means include spike-shaped parts for installation in the ground.

* * * * *